US006337008B1

(12) United States Patent
Christensen et al.

(10) Patent No.: US 6,337,008 B1
(45) Date of Patent: Jan. 8, 2002

(54) ELECTROLYSIS CELLS

(75) Inventors: Jorgen Christensen; David K. Creber; George C. Holywell, all of Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/591,408

(22) Filed: Jun. 12, 2000

(51) Int. Cl.[7] ..... C25B 1/00
(52) U.S. Cl. ..... 205/357; 204/247
(58) Field of Search ..... 204/245, 247; 205/357

(56) References Cited

U.S. PATENT DOCUMENTS

| | | | | |
|---|---|---|---|---|
| 1,567,318 A | | 12/1925 | Cottringer et al. | 205/244 |
| 3,418,223 A | | 12/1968 | Love et al. | 204/70 |
| 3,676,323 A | | 7/1972 | Strelets et al. | 204/244 |
| 4,073,703 A | | 2/1978 | Kinosz et al. | 204/70 |
| 4,198,282 A | | 4/1980 | Andreassen et al. | 204/243 R |
| 4,514,269 A | * | 4/1985 | Sivilotti | 204/69 |
| 5,935,394 A | | 8/1999 | Sivilotti et al. | 204/244 |

FOREIGN PATENT DOCUMENTS

| | | |
|---|---|---|
| SU | 605864 | 4/1978 |

OTHER PUBLICATIONS

Kh. L. Strelets, "Electrolytic Production of Magnesium", Chapter XIII, Izdatel'stvo "Metallurgiya" Moskva, 1972, pp. 250–265.

Nils Hoy–Peterson, "From Past To Future", 47$^{th}$ Annual World Meeting, 1990. Cannes, France, pp. 18–23.

* cited by examiner

*Primary Examiner*—Kathryn Gorgos
*Assistant Examiner*—Thomas H Parsons
(74) *Attorney, Agent, or Firm*—Cooper & Dunham, LLP

(57) ABSTRACT

An electrolysis cell for recovery of metals that are lighter than the electrolyte used in the cell. The cell makes use of multiple electrode assemblies, and each assembly is provided with an individual hood at the top forming a gas collection chamber. The hood of each assembly collects gas generated by the assembly and isolates the gas thus generated from gas generated by other assemblies and from metal collecting in the cell outside the hoods. The invention also relates to an integrated unit made up of an electrode assembly and an associated hood for use in a cell of the above kind, and a method of recovering metal by operating a cell of the above kind.

22 Claims, 6 Drawing Sheets

ELECTROLYSIS CELLS

BACKGROUND OF THE INVENTION

1. Field of the Invention

This invention relates to electrolysis cells used for the production of light metals, such as magnesium, lithium, sodium and aluminum, by electrolysis of a molten electrolyte having a greater density than the metal produced. More particularly, the invention relates to electrolysis cells of this kind that have means for separating newly formed molten metal from reactive gases produced during the electrolysis process.

2. Description of the Related Art

The production of magnesium metal is typical of the procedures to which the present invention relates. Magnesium metal is generally produced from magnesium chloride by electrolysis in a suitable electrolytic cell held at a temperature high enough to keep both the electrolyte and the metal product molten during the process. The electrolysis creates droplets of magnesium metal and chlorine gas. Since magnesium is a very light metal, it floats to the surface of the electrolyte, as do the bubbles of the chlorine gas. It is therefore necessary to keep the floating pool of metal separate from the chlorine gas collecting in the atmosphere above the electrolyte, or these elements will merely recombine, thereby reducing the current efficiency of the cell.

A typical modern cell design is described in U.S. Pat. No. 5,935,394 to Sivilotti et al. which issued on Aug. 10, 1999 and was assigned to the same assignee as the present application. This cell utilizes a number of multi-polar cell assemblies per cell that are arranged in a line along one long side wall of the cell. As best shown in FIG. 2 of the patent, a longitudinal refractory curtain wall is provided adjacent to the cell assemblies to separate a compartment within the cell for the electrode assemblies from a metal collection compartment. Electrolyte containing metal droplets overflows the top end of the multi-polar electrodes of each assembly (driven by the buoyancy of entrained gas) and flows through an upper aperture in the refractory wall positioned below the surface of the electrolyte. Gas entrained in the electrolyte escapes into the atmosphere above the electrode assemblies before the metal-containing overflow progresses through the aperture in the curtain wall. After passing through that aperture, the electrolyte encounters a quiescent zone where the metal droplets can rise to the surface, coalesce and collect as a pool. A further aperture at the bottom of the curtain wall allows metal-depleted electrolyte to recirculate to the electrode compartment. In this way, the chlorine gas is kept separate from the floating pool of molten metal.

There are, however, a number of disadvantages with this type of cell. Firstly, the electrolyte overflows the interpolar electrodes of each electrode assembly at all points around the upper end of the assembly. The overflowing electrolyte is collected in a trough surrounding the assembly and brought around to a position adjacent to the aperture in the curtain wall so that it can proceed through the aperture into the metal collection chamber. However, electrolyte that overflows the electrodes at points remote from the aperture spend a considerable amount of time in the electrode compartment where the metal droplets may contact the chlorine gas and may react, thus reducing the current efficiency of the cell.

Secondly, the cell has to be shut down if one of the electrode assemblies has to be removed for maintenance or repair because the headspace within the electrode compartment is common to all electrode assemblies, and chlorine gas produced by functioning assemblies would escape from an aperture in the cell opened for the removal of another cell assembly.

Thirdly, the use of an elongated curtain wall extending the full length of the long dimension of the cell reduces the operational life of the cell and limits the maximum cell dimensions. Such walls are exposed to corrosive chemicals on both sides, so that failure is fairly frequent. When such an integral component fails, it is necessary to shut down the cell completely and to remove the cell contents so that the wall can be rebuilt. This is obviously time consuming, difficult and expensive. Moreover, an unduly long wall would be structurally weak and prone to mechanical failure.

As well as exhibiting the problems referred to above, the cell of the Sivilotti et al. patent also has the problem that the electrical bus bar for the cathode connection exits the cell directly through a side wall at a position below the surface of the electrolyte. While this protects the metal bus from attack by chlorine gas, it makes any removal of electrode assemblies more difficult since the cathode connections are not easily accessible.

Accordingly, there is a need for an improved design of electrolysis cells of this kind to alleviate some or all of the problems of this kind.

SUMMARY OF THE INVENTION

An object of the present invention is to make electrolysis cells used for the production of light metals, such as magnesium, easier to construct, maintain and/or to repair.

Another object of the present invention is to increase the operational life of electrolysis cells used for the production of light metals, such as magnesium.

A further object of the present invention, at least in preferred forms, is to reduce the contact time between metal and chlorine in electrolysis cells of the kind discussed.

A further object of the present invention, at least in preferred forms, is to make individual electrode assemblies operationally independent of each other within an electrolysis cell.

A still further object of the invention, at least in preferred forms, is to make repair or maintenance of electrolysis cells possible without a complete cell shut-down.

According to one aspect of the invention, there is provided an electrolysis cell for recovery of a metal by electrolysis from a molten electrolyte containing a metal compound, wherein the molten metal has a density lower than the molten electrolyte and the compound produces a gas during electrolysis that reacts on contact with the molten metal, the cell having a housing containing a plurality of electrode assemblies each including an anode, a cathode and at least one interpolar electrode disposed between the anode and the cathode so as to form interpolar spaces in which electrolysis occurs, and connections for conveying electrical current to and from the electrode assemblies; wherein each electrode assembly is provided with a hood enclosing an upper portion of the electrode assembly including the cathode of the assembly, such that the hood in operation provides a gas collection chamber such that the gas generated by each electrode assembly is isolated from other electrode assemblies and from metal collecting in the housing outside each hood.

According to another aspect of the invention, there is provided a method of recovering a metal by electrolysis from a molten electrolyte containing a metal compound, the molten metal having a density lower than the molten electrolyte and the compound producing a gas during electrolysis that reacts on contact with the molten metal, in which electrolysis is conducted in a cell having a housing containing a plurality of electrode assemblies each including an anode, a cathode and at least one interpolar electrode disposed between the anode and the cathode so as to form interpolar spaces in which electrolysis occurs, and connections for conveying electrical current to and from the electrode assemblies; wherein the gas from each electrode assembly is collected in a hood enclosing an upper portion of the electrode assembly including the cathode of the assembly and providing a gas collection chamber, such that the gas generated by each electrode assembly is isolated from other electrode assemblies and from metal collecting in the housing outside each hood.

According to another aspect of the invention, there is provided an integral electrolysis unit comprising an electrode assembly having an anode, a cathode and at least one interpolar electrode, and a hood encircling an upper end of the to electrode assembly, the hood including a lower end sealed in a gas-fight manner against a periphery of the cathode, except at at least one open aperture at a point on the periphery of the cathode.

According to yet another aspect of the invention, there is provided an electrolysis cell for recovery of a metal by electrolysis from a molten electrolyte containing a metal compound, wherein the molten metal has a density lower than the molten electrolyte and the compound produces a gas during electrolysis that reacts on contact with the molten metal, the cell having a housing containing a plurality of electrode assemblies each including an anode, a cathode and at least one bipolar electrode disposed between the anode and the cathode so as to form interpolar spaces in which electrolysis occurs and the cathode forms an electrically and mechanically continuous surface surrounding the outermost at least one bipolar electrode, and connections for conveying electrical current to and from the electrode assemblies; wherein each electrode assembly is provided with a hood enclosing an upper portion of the assembly such that (a) the hood in operation provides a gas collection chamber such that the gas generated by the electrode assembly is isolated from the remaining electrode assemblies and (b) the hood and outer surface of the cathode are in a spaced relationship so that in operation, electrolyte flow containing the metal formed on the electrodes can flow over the top of the cathode and under the edge of the hood substantially adjacent the cathode over which it flowed.

In a preferred form of the cell, a current bus for the cathode of each assembly attaches to the cathode below a lower end of the associated hood and extends within the cell outside the hood to the cell roof, where it exits the cell through an aperture in the roof.

DETAILED DESCRIPTION OF THE PREFERRED EMBODIMENTS

Figure 1:
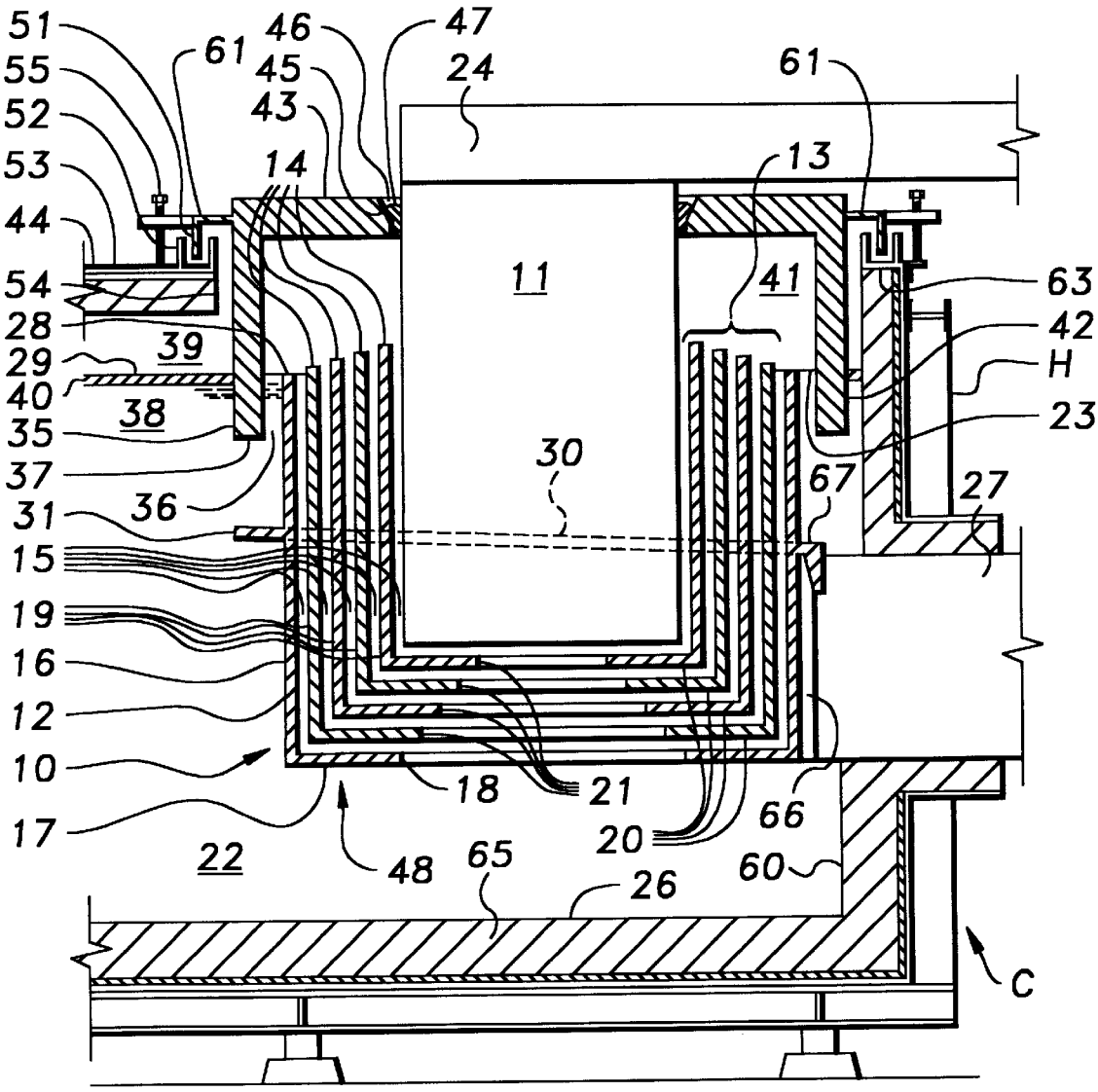
FIG. 1 is a vertical cross-section of a part of an electrolysis cell according to one preferred embodiment of the present invention showing an electrode assembly provided with a hood.

FIG. 1 is a partial view of a magnesium electrolysis cell C of the type disclosed in U.S. Pat. No. 5,935,394 (the disclosure of which is incorporated herein by reference) including one embodiment of an improvement according to the present invention. The drawing shows the region of the cell housing H surrounding just one electrode assembly 10, but it will be understood that the cell contains a plurality of such assemblies, usually four or more. The cell design may in many other respects be conventional, e.g. it is provided with a refractory layer 65 lining the interior of the sidewalls 60 and the cell floor 26.

The electrode assembly 10 consists of a central anode 11 (usually made of graphite), a cathode 12 completely encircling the anode across an annular gap 13, and a plurality of interpolar electrodes 14 positioned in the annular gap between the anode and the cathode in spaced relationship to each other to form annular channels 15. The cathode consists of a cylindrical wall 16 and a flat bottom wall 17 having a central hole 18. The interpolar electrodes are of similar shape to the cathode, but are progressively smaller in size. Each consists of an annular wall 19 and a flat bottom wall 20 provided with a central hole 21. The bottom wall 17 of the cathode and the bottom wall 20 of the interpolar electrodes may also be sloped upwardly from the centre. The hole 18 of the cathode and the holes 21 of the interpolar electrodes are concentric and provide a route by which molten electrolyte 22, may enter the annular channels 15.

The central anode 11 is supported from above and is electrically connected to a current bus bar 24. The cathode 12 is supported from a current bus bar 27 which, for this purpose, is provided with an end plate 66 at right angles to the remainder of the bus bar 27. The end plate 66 engages the cylindrical wall of the cathode and a hook 67 on circumferential plate 30 holds the cathode assembly firmly in place. If desired, the cathode 12 may also be supported from below by spaced supports (not shown) extending upwardly from the cell floor 26. The interpolar electrodes are supported by electrically-insulating spacers (not shown) positioned between the cathode and the outermost interpolar electrode, and then between adjacent interpolar electrodes. The cathode 12 is electrically connected to and supported from current bus bar 27 that supplies the electrolyzing current for cell operation. The upper surface 23 of the molten electrolyte corresponds in height to the upper end 28 of the cathode 12 so that electrolyte substantially fills all of the annular channels 15 where electrolysis takes place. Metal droplets and gas bubbles form within the electrolyte as electrolysis proceeds and the buoyancy created by the gas lifts the electrolyte to the top of the electrode assembly, where it overflows. Fresh electrolyte is drawn in through the holes 18 and 21 to replace the overflowing electrolyte so that there is a continual flow of electrolyte through the electrode assembly.

The electrode assembly includes circumferential plate 30 that is integral with and surrounds the cathode 12 and has an outer edge 31. The plate may be horizontal, but preferably slopes slightly upwardly from the side having the hook 67 as shown or may slope slightly upward in all directions concentrically around the electrode assembly. Together with corresponding plates of other electrode assemblies, the plate forms a roughly horizontal partition in the cell and serves to prevent electrolyte containing magnesium droplets overflowing the top of the assembly from returning directly to the bottom of the assembly.

As already noted, in conventional cells of this kind, a refractory curtain wall is provided in the cell to separate an electrolysis chamber containing the electrode assemblies 10 from a metal collection chamber where droplets of molten metal coalesce and rise to the surface to form a metal pool that is tapped from the cell continuously or intermittently. The curtain wall contains strategically placed ports for transfer of molten electrolyte between the two chambers. Gas bubbles emerge from the molten electrolyte far more quickly than the metal droplets coalesce and rise to the surface, so the gas collects in the electrolysis chamber while the metal is carried through with the electrolyte to the metal collection chamber. Gas and metal are thus kept separate so that back-reaction is avoided.

In the illustrated embodiment of the present invention, there is no conventional curtain wall. Instead, each electrode assembly is provided with a hood 35 that forms a gas collection chamber 41 that encircles and encloses the upper end of the cathode 12, the interpolar electrodes 14 and the anode 11, and extends downwardly to a level below the upper surface 23 of the electrolyte 22 and the upper surface 29 of the metal pool 40 within the cell, but not completely to the bottom of the cell. As the electrolyte overflows the channels 15, gas escapes and is collected within the hood 35, and the metal-containing electrolyte then flows over the upper end 28 of the cathode 12 and down through an annular channel 36 formed between the cathode 12 and the lower end 37 of the hood 35. From there, the metal-containing electrolyte flows out of confinement by the hood 35 into a common area 38 of the housing H of the cell C where metal coalescence and collection takes place to form the metal pool 40. The electrolysis gases collected within the hood 35 are vented through suitable piping (not shown in FIG. 1, but see FIG. 5) for disposal as in conventional cells.

Consequently, instead of having a common electrolysis chamber containing all of the electrode assemblies provided with a common headspace for gas collection, the illustrated embodiment has an individual electrolysis and gas-collection chamber for each electrode assembly provided by the hoods 35, and a common area 38 outside the hoods 35 forms a metal collection chamber that forms a common metal pool 40 collecting metal from all of the electrode assemblies 10.

The lower end of the hood 35 is preferably the same shape as the cathode top to provide a substantially uniform gap around the periphery. It may be cylindrical, but could be of any shape (e.g. square, rectangular or elliptical) provided the necessary gas confinement is achieved.

One advantage of this arrangement is that metal-containing electrolyte overflowing the upper end 28 of the cathode 12 at any point around the periphery of the cathode may flow directly out of the electrolysis chamber through the annular channel 36 and under the lower end 37 of the hood. In conventional cells, there is usually a single port in the curtain wall adjacent each electrode assembly and metal-containing electrolyte from the far side of each assembly has to be channeled through the electrolysis compartment around the cathode to a point adjacent to the port. This means that the metal has a much longer residence time in the electrolysis compartment where reaction with gas in the headspace of the compartment may take place. The residence time of the metal-containing electrolyte in the electrolysis compartment is minimized in this embodiment of the present invention, so that back-reaction is also minimized.

Another advantage of the illustrated embodiment is that the hood 35 can, if desired, be removed from the cell without undue difficulty, e.g. for replacement or repair. The hood consists of a vertical annular wall 42 and an integral flat horizontal wall 43 that forms a removable part of the cell roof 44. The hood may also have a top surface in the form or a hemisphere or a frustro-conical section or any other convenient form. The flat horizontal wall 43 has a central hole 45 allowing the anode 11 to enter the housing H. The gap 46 between the edges of hole 45 and the anode 11 are made gas-tight by insertion of a flexible and removable packing material 47. The packing material also preferably provides electrical insulation between the anode and the hood. This arrangement makes it possible to remove the anode 11 (after removing the packing material) without disturbing the hood 35 and the cathode assembly 48 (which is the cathode 12 and interpolar electrodes 14 minus the anode 11), or both the anode and the hood, or all of the anode, the hood and the cathode assembly, as desired.

The hood may be made of any suitable material. For example, it may be formed as a single piece of refractory or jointed refractory blocks. It may be made from graphite provided the graphite is suitably protected from oxidation (in the known manner). It may also be made from steel lined by a suitable refractory such as an alumina or aluminum silicate refractory. This lining for the steel may be applied as a castable or gunned mixture, or as refractory blocks using attachment fixtures or techniques well known in the art.

The removable design of the hood makes it easy to replace or repair the hood, unlike the normal curtain walls that are subject to the same environments. While it would be prudent for safety reasons to interrupt the flow of electricity to all of the electrode assemblies of the cell when working on one assembly, and to tap off as much of the metal pool 40 as possible, the fact that the hood can be removed from above (i.e. from the top of the cell C) means that the cell does not have to be cooled and the electrolyte removed. The repair or replacement of the hood can therefore be carried out quickly and economically, while the cell is kept hot, working on one cell assembly at a time, or on more than one assembly concurrently. Moreover, the headspace 39 of the cell does not have to be cleared of dangerous gases because these gases are confined within the hood 35 of each cell assembly, and only the hood of a cell assembly undergoing repair need be flushed of electrolysis gases before work commences. Again, this simplifies and accelerates cell repair and minimizes down-time.

Since the corrosive electrolysis gases are confined within the hood 35, it is not essential to seal the roof of the cell above the common headspace 39 for environmental or safety reasons, but this is still desirable for several reasons (e.g. to minimize the entry of air which would oxidize the molten metal collected in the metal collection areas of the cell). As shown in FIG. 1, this can be done by providing a cover panel which outwards from the the periphery of the hood 35 and is used to seal the hood 35. The cover panel has a projecting lip 51 that sits in a trough 52 formed on the upper surface 53 of the cell roof 44 around the aperture 54 provided for receiving the hood 35. The trough may contain a flexible sealing material or powder (not shown). For convenience, the trough may be supported in part by the upper edge 63 of the sidewall as well as the cell roof. The vertical position of the hood 35 can be adjusted by means of an adjustment screw 55 or by means of blocks or wedges. This permits the degree of immersion of each hood in the electrolyte to be adjusted, and this adjustment can be made independently of the other hoods. The hood immersion is used to help control the rate of electrolyte flow through and over the top of the electrode assembly and the individual hood adjustment permits such control to be accomplished for each electrode assembly independently. The adjustment of electrolyte flow is useful to compensate for performance changes caused be electrode wear or other reasons and the independent adjustment permits individual compensation for electrode assemblies, a feature not heretofore possible.

Figure 2:
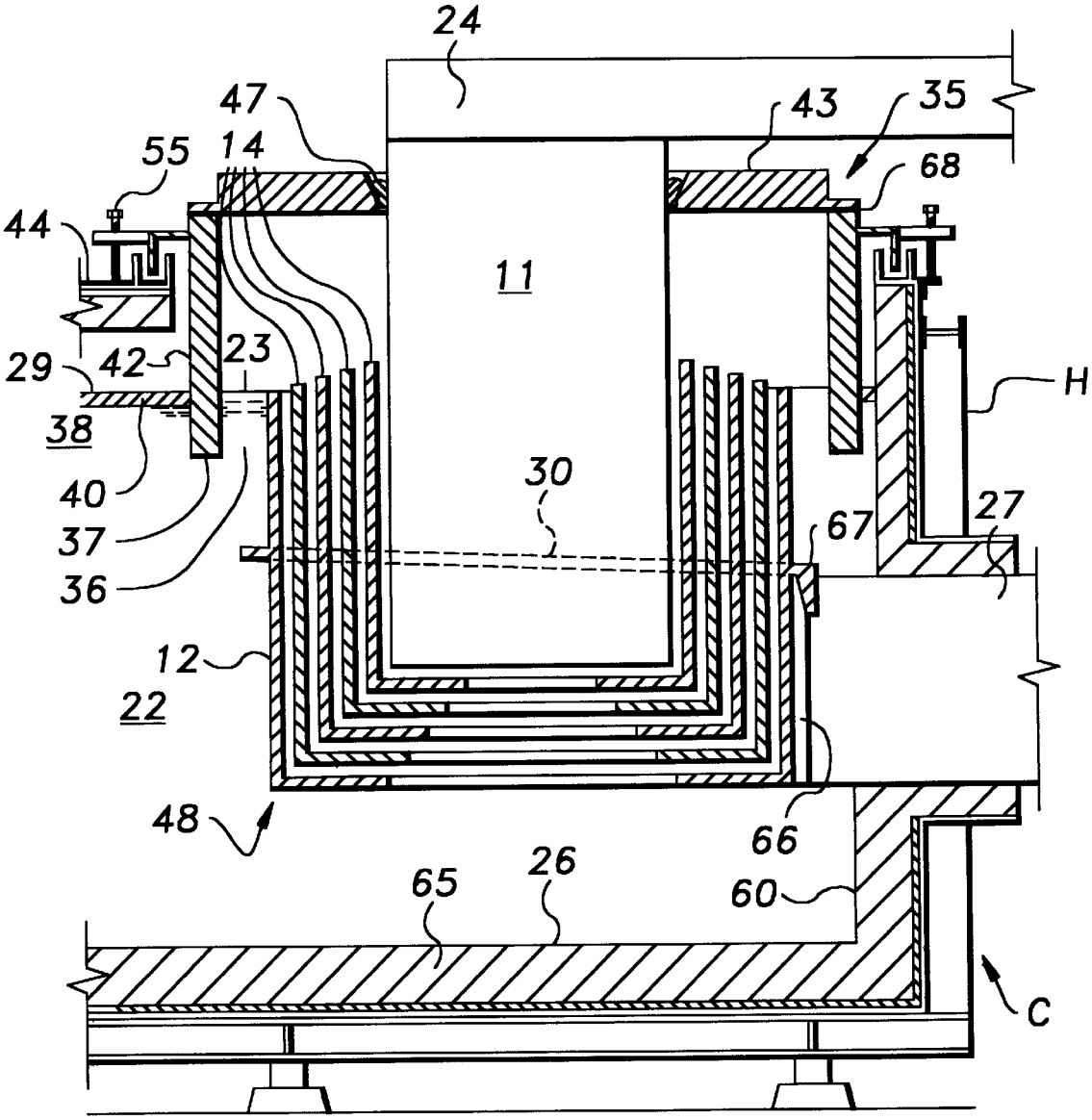
FIG. 2 is a partial cross-sectional view similar to that of FIG. 1 illustrating an alternative preferred embodiment of the invention.

FIG. 2, which is a view similar to FIG. 1, shows an alternative preferred embodiment of the present invention. The embodiment of FIG. 2 differs from that of FIG. 1 most notably in the design of hood 35. In this case, the hood is formed in two separable parts, i.e. a vertical annular wall 42 and separable flat horizontal wall 43. This allows the flat horizontal wall 43 to be removed while the vertical annular wall is kept in place within the cell. The anode 11 and, if desired, the cathode assembly 48, may be removed without disturbing the vertical annular wall 42 of the hood 35 so that the metal pool 40 can be prevented from overflowing into the electrolysis compartment, and gases in the common area 38 of the cell can be kept confined to that area. To ensure that this is achieved, the vertical annular wall 42 of the hood should be long enough to extend deeply enough into the molten electrolyte 22 so that the lower end 37 of the hood always remains below the upper surface 23 of the molten electrolyte and the upper surface 29 of the metal pool despite variations in the height of that surface due, for example, to the removal of an electrode assembly (the cell may be provided with a level control device to minimize such variations in practice). Such a level control device is described for example in U.S. Pat. No. 5,935,394 (the disclosure of which is incorporated herein by reference).

The junction 68 between the two separable parts 42 and 43 of the hood should be gas tight. A sealing gasket (not shown) may be provided, if necessary, to achieve this.

Of course, while the vertical side wall 42 of the hood may be left in place when removing the anode 11 and/or the cathode assembly 48, the vertical side wall may also be removed from the cell if desired, e.g. for maintenance or repair. Separate hoists (not shown) may therefore be needed for the two hood parts.

Figure 3:
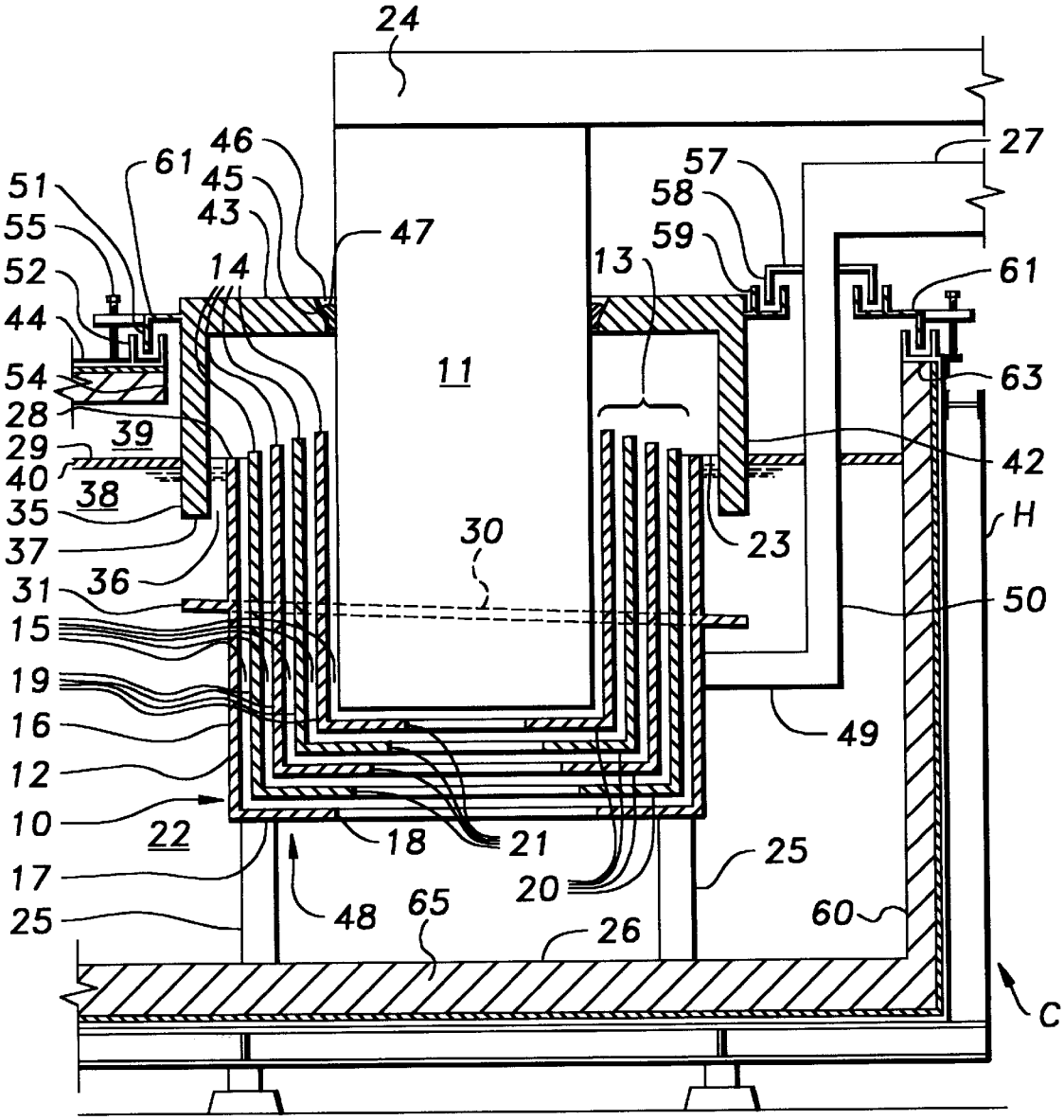
FIG. 3 is a partial cross-sectional view similar to FIG. 1 illustrating a further alternative preferred embodiment of the invention.

FIG. 3, which is a view also similar to FIG. 1, shows a further alternate preferred embodiment of the present invention. In this embodiment, the cathode 12 is supported from below be spaced supports 25 extending upwards from the cell floor 26, which avoids the need to provide a supporting structure based on the cathode bus bar 27. The embodiment illustrated in FIG. 3 also has the advantage that the cathode bus bar 27 exits through the cover panel 61 rather than through a cell wall (as in conventional cells of this kind). Metal bus bars are rapidly corroded by electrolysis gases and therefore, in a conventional cell, they may not pass through the headspace of the cell where electrolysis gases collect. They are therefore routed directly through an adjacent cell wall at a position below the upper surface of the electrolyte, but this creates a possible point of cell wall failure. In the illustrated embodiment, corrosive electrolysis gases are confined within the hood 35 and there are no such gases within the general headspace 39 of the cell. Accordingly, a short horizontal section 49 of the bus bar 27 projects beyond the "shadow" of the hood 35 within the protection of the molten electrolyte 22 and then a vertical section 50 extends upwardly through the general headspace 39 and through a portion of the cover panel 61 where (like the anode bus bar 24) it can conveniently be routed above the cell to the electrical supply (not shown).

In the region where the cathode bus bar 27 extends through the cover panel 61, the cathode busbar 27 has a panel 57 having a peripheral lip 58 which sits in a trough 59 provided around the opening in the cover panel 61 through which the cathode bus bar passes. Again, a seal is created by means of a flexible packing material or powder (not shown). In order that the illustrated design permit the hood 35 to be vertically adjustable, this packing material must permit vertical movement of the lip 58 within the trough 59. The aperture 54 is large enough to allow the entire electrode assembly 10 and bus bar 27 to be removed from the cell when desired.

There is no need to arrange the electrode assemblies 10 in the conventional manner within the housing H of the cell C, i.e. there is no need to arrange the electrode assemblies along one longitudinal cell side wall, although this arrangement may be retained, if desired. As previously noted, the conventional cell requires an longitudinal electrolysis compartment along one long side of the cell and a metal collection compartment along the opposite long side wall of the cell with a refractory curtain or partition wall extending between and defining these compartments. The metal collection compartment has traditionally required a large surface area to reduce the downward electrolyte velocity to limit the amount of metal that is recirculated to the electrolysis compartment. In the present invention, the area can be increased, without changing the outside dimensions of the cell. This is because hoods 35 of the electrode assemblies 10 take up less surface area of the cell than a common electrolysis compartment of the conventional cell. Moreover, the assemblies of the present invention can be located in any arrangement within the cell because each assembly has its own electrolysis compartment formed by hood 35, and the metal collection chamber is common to all electrode assemblies and is merely the area of the cell outside the hoods 35. This freedom of positioning of the electrode assemblies means that it may be possible to introduce more electrode assemblies within a cell of a given size than is possible with conventional cells, and/or to optimize the routing of bus bars.

It should also be noted that the size of a conventional cell is limited because an increase in size requires an increase in length of the longitudinal curtain wall, which becomes relatively weaker and thus reduces the operational life of the cell. In the present invention, the cell size may be increased to accommodate more electrode assemblies without any penalty to the operational life of the cell. Cells according to the present invention may therefore be made larger than conventional cells, if desired.

Figure 4:
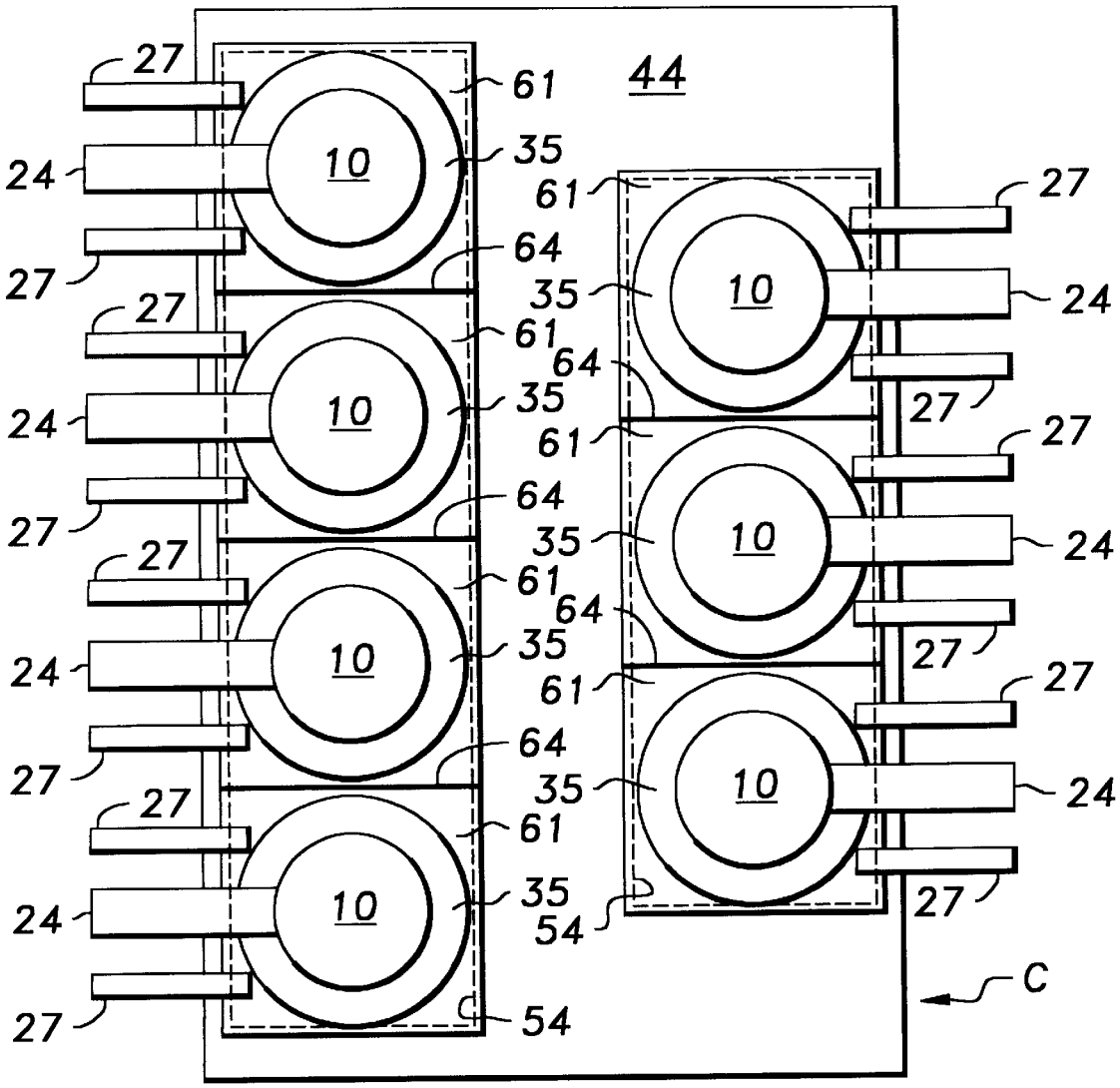
FIG. 4 is a plan view from above of an electrolysis cell showing one example of the distribution of electrode assemblies and associated hoods therefor.

A densely packed, uniformly oriented array of electrode assemblies within an electrolysis cell C is shown in FIG. 4, which is an overhead plan view of the roof 44 of the cell. The cell has an elongated rectangular upper surface that includes hoods 35 and cover panels 61 covering apertures 54. Anode bus bars 24 and cathode bus bars 27 are visible and are arranged with good separation. In a cell that would conventionally hold four such assemblies, seven such electrode assemblies 10 are provided, four along one side wall and 3 along the opposite side wall of the cell. This means that the output of the cell may be almost double that of a conventional cell of the same size. Of course, other arrays of electrode assemblies may be preferred, as will be apparent to a person skilled in the art. In this embodiment, the cover panels are rectangular or square in shape, whereas the hoods are circular. The projecting lips and troughs are provided only on two, or at most three sides of the hood 35, and the remaining edges 64 are sealed using metal plates, troughs, heat resistant fabric, pitch, packing material, powder or similar means.

Figure 5:
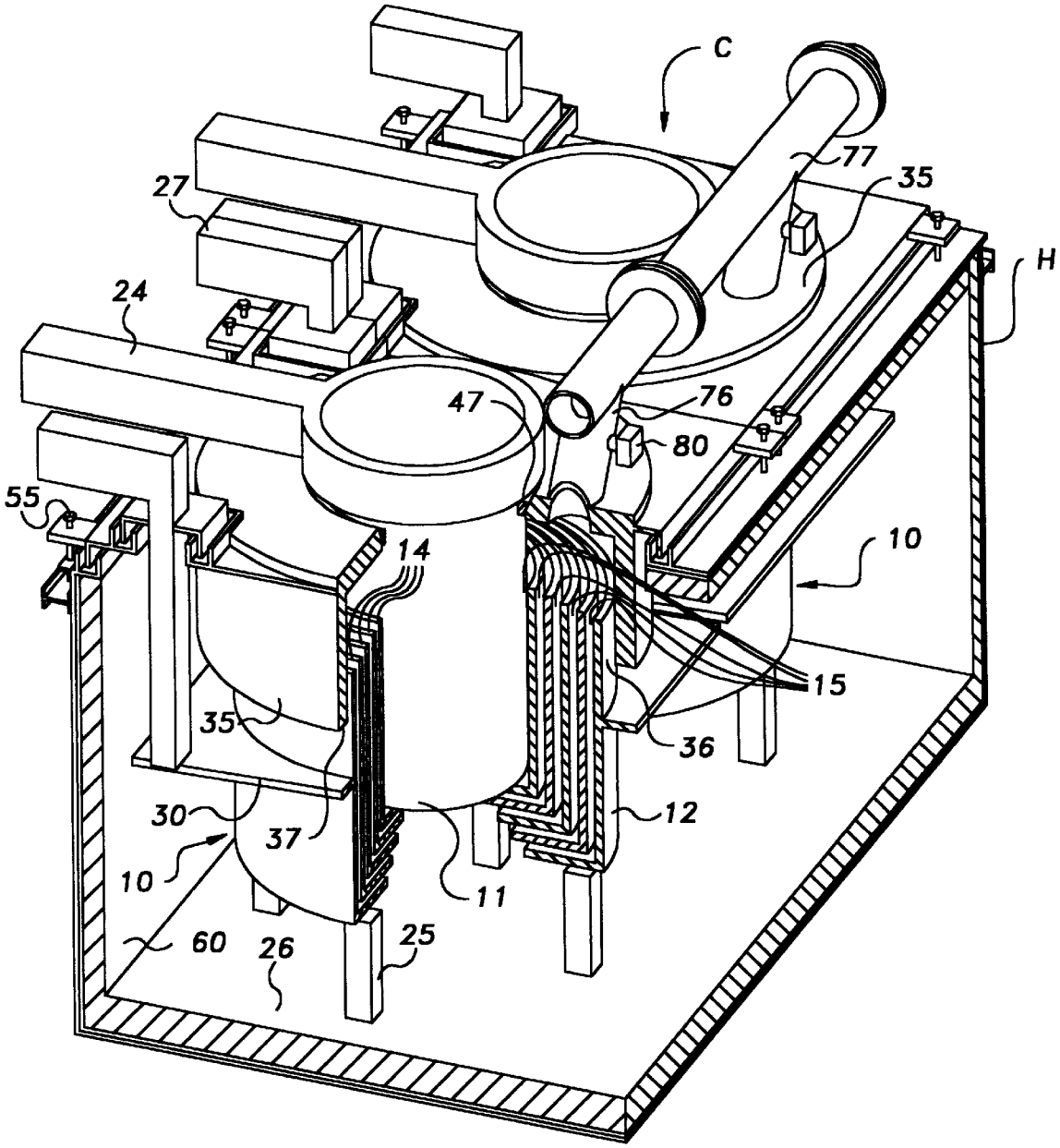
FIG. 5 is a perspective view of a cell partly in section with parts removed for clarity, showing two side-by-side electrode assemblies of the kind shown in FIG. 3.

FIG. 5 shows part of an electrolysis cell C having a housing H provided with several side-by-side electrode assemblies 10 and encircling hoods 35 (two are shown) constructed according to FIG. 3. In addition to the features shown in these figures, the illustration also shows vents 76 for removal of electrolysis gases from the interior of the hoods 35. Piping 77 connects with the vents 76 for conveying the electrolysis gases to treatment or storage facilities (not shown). Flanges are provided in the piping 77 to permit demounting and isolating of individual hoods should the need arise. It is normal to maintain a slight vacuum in the vents to facilitate chlorine removal and it is advantageous in the present invention to place manual or automatically controlled dampers 80 in each pipe 76 to permit the vacuum level to be independently adjusted for each electrode assembly. The vacuum level provides a fine control of the electrolyte level in each electrode assembly (the level control means described above providing an overall control) and this in turn provides control of the electrolyte flow through the assembly either in conjunction with the immersion of the hood already described or separately in order to compensate for differences in operating conditions between electrode assemblies. The vacuum control may be accomplished, for example, by applying the methods described in European Patent Application EP0915187 (the disdosure of which is incorporated herein by reference) where the methods are, however, in this case applied to each hood and electrode assembly within a cell rather than to separate cells.

Figure 6:
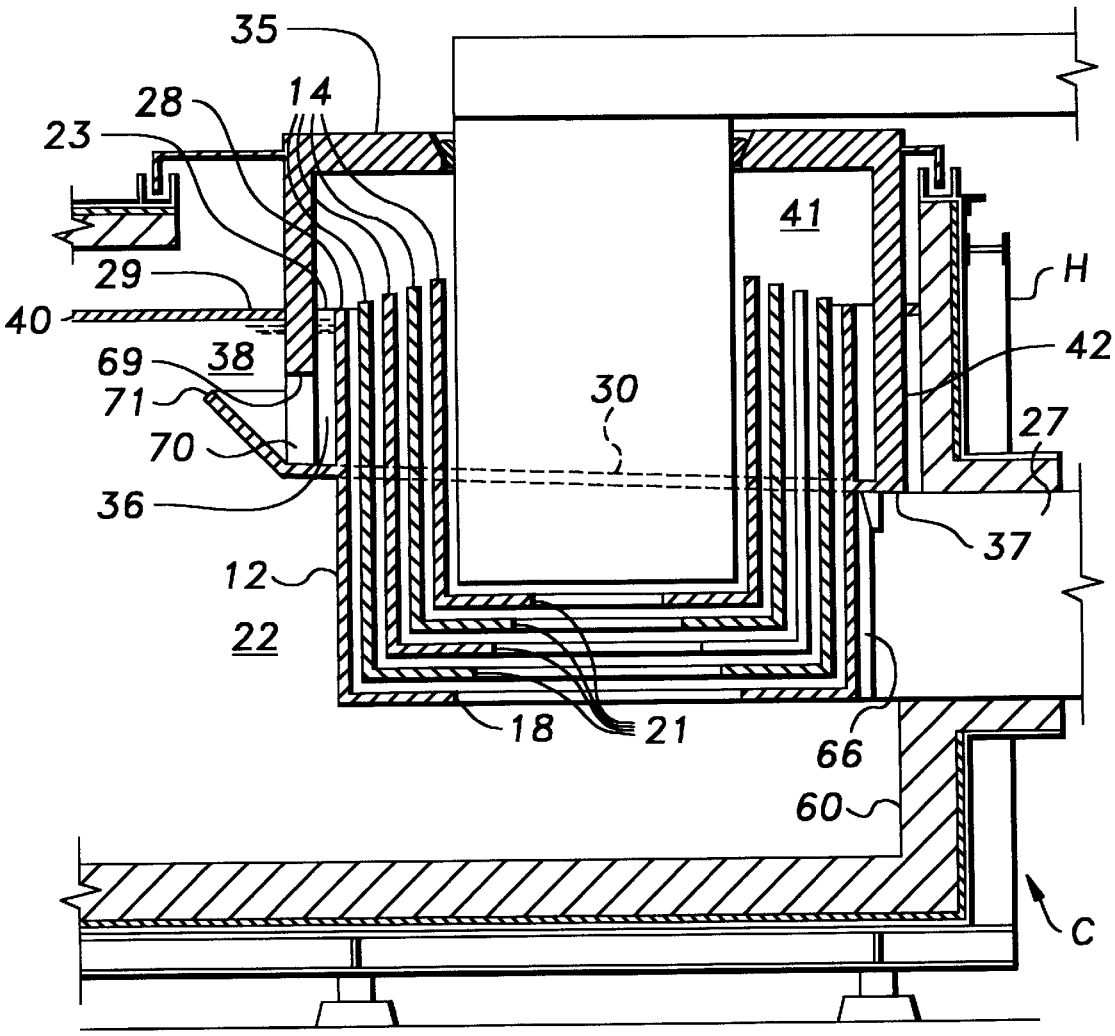
FIG. 6 is a partial cross-sectional view similar to FIG. 1 illustrating a further alternative preferred embodiment of the invention, using a unitary hood and electrode assembly.

While, as explained above, there is a significant advantage in providing a hood 35 having a lower end 37 that is spaced from the cathode around the entire cathode periphery, an alternative design according to the present invention has a hood contacting the periphery of the cathode 12 or the plate 30, except at an exit port for the metal-containing electrolyte. An embodiment of this kind is shown in FIG. 6, which is a view similar to that of FIG. 1. As shown, the lower end 37 of the vertical wall 42 of the hood 35 rests directly on and may be attached to the plate 30 extending from the cathode 12, thus sealing off the interior of the hood forming the gas-collection chamber 41 from the remainder of the cell around the cathode periphery. At a position opposite the side wall 60 of the cell, the vertical wall 42 has a foreshortened portion 69 forming an aperture 70 through which metal-containing electrolyte overflowing the cathode may pass to the metal collection area of the cell outside the hood 35. This aperture is positioned below the normal height of the surface 23 of the molten electrolyte 22 and the surface 29 of the metal pool 40 so that electrolyte gases collecting within the hood 35 cannot escape to the common area 38 of the cell outside the hood 35. Naturally, electrolyte may still flow into the electrode assembly from below through aligned holes 18 and 21 to replace the electrolyte leaving the aperture 70.

Projecting from the lower front edge of the aperture 70 into the interior of the cell is an upwardly angled metal plate 71. The metal-containing electrolyte exiting aperture 70 is deflected upwardly by the angled plate 71 and comes into contact with the underside of the metal pool 40.

While this embodiment has the disadvantage that metal-containing electrolyte overflowing the upper end 28 of the cathode 12 at points remote from the aperture 70 must flow around the cathode periphery in the annular channel 36 formed between the cathode 12 and the hood 35, which means that there is greater residence time of the metal in the electrolysis chamber formed within the hood and hence more risk of reaction with the electrolysis gases than is the case for the earlier-described embodiments, this embodiment has the advantage that the electrode assembly may be produced as a unitary structure that can be inserted into and removed from the cell as a single unit. The embodiment still has the advantage that the corrosive and dangerous electrolysis gases are confined to the interior of the hood 35, and the metal is collected in the remainder of the cell.

The disadvantage of having a single aperture can be overcome to some extent by providing a plurality of apertures similar to the aperture 70 around the periphery of the hood and at a same level. If uniformly spaced, such apertures permit electrolyte to exit from the space between the other surface of the cathode and the hood in a substantially uniform manner thus retaining some of the benefits of the previous embodiments while permitting a unitary structure to be used.

Having described preferred embodiments of the invention, other modifications, alterations and improvements will readily occur to persons skilled in the art. All such modifications, alterations and improvements within the spirit and scope of the present invention are to be regarded as forming part of the invention.

What we claim is:

1. An electrolysis cell for recovery of a metal by electrolysis from a molten electrolyte containing a metal compound, wherein the molten metal has a density lower than the molten electrolyte and the compound produces a gas during electrolysis that reacts on contact with the molten metal, the cell having a housing containing a plurality of electrode assemblies each including an anode, a cathode and at least one interpolar electrode disposed between said anode and said cathode so as to form interpolar spaces in which electrolysis occurs, and connections for conveying electrical current to and from said electrode assemblies; wherein each electrode assembly is provided with a hood enclosing an upper portion of the electrode assembly including the cathode of said assembly, such that the hood in operation provides a gas collection chamber such that said gas generated by each said electrode assembly is isolated from other electrode assemblies and from metal collecting in said housing outside each said hood.

2. The cell of claim 1, wherein the hood of each electrode assembly has a lower edge, and wherein said lower edge and an outer surface of the cathode are in a spaced relationship, so that in operation, electrolyte flow containing metal formed on the electrodes can flow over the top of the cathode and under the lower edge of the hood all around said lower edge of the hood.

3. The cell of claim 1, wherein the cell has a cell roof and the hood of each electrode assembly is at least partially removable through said cell roof when required for replacement, maintenance or repair.

4. The cell of claim 3, wherein the hood of each electrode assembly is fully removable from the cell through said cell roof.

5. The cell of claim 3, wherein the hood comprises a generally horizontal upper element and a generally vertical annular element, said elements being separable and at least the upper element being removable through said cell roof.

6. The cell of claim 5, wherein each said electrode assembly is removable from said cell through said roof while said annular element of said hood remains in said housing.

7. The cell of claim 3, wherein the hood of each electrode assembly is removable independently of the hood of each other assembly.

8. The cell of claim 1, wherein said housing includes a cell roof, and said connections include a cathode bus bar for each assembly, said cathode bus bar extending into said housing through said roof and connecting to said cathode while remaining outside said hood.

9. The cell of claim 8, wherein said cathode bus bar of each electrode assembly is removable through said roof along with said electrode assembly.

10. The cell of claim 1, wherein said hood is sealed to the cathode at a lower end thereof except for at least one aperture to allow metal-containing electrolyte to exit said hood.

11. The cell of claim 10, wherein there is a plurality of apertures uniformly distributed around the periphery of said hood.

12. The cell of claim 10, wherein said aperture has a plate extending outwardly and upwardly into an interior of said housing to deflect said metal-containing electrolyte to a surface of a body of electrolyte held in said housing.

13. The cell of claim 10, wherein the cathode of each electrode assembly has a generally horizontal plate extending from the periphery thereof, and said lower end of said hood engages said plate, except at said aperture, to cause said lower edge to be sealed.

14. The cell of claim 1, wherein said housing has side regions on opposite sides of a longitudinal center line and said electrode assemblies are provided in both said side regions of the housing.

15. The cell of claim 1, wherein each hood has a vent for removal of electrolysis gases from said gas collection chamber.

16. The cell of claim 15, wherein each of said vents has a control valve within the said vent.

17. The cell of claim 1, wherein each hood and associated electrode assembly form an integral unit.

18. An electrolysis cell for recovery of a metal by electrolysis from a molten electrolyte containing a metal compound, wherein the molten metal has a density lower than the molten electrolyte and the compound produces a gas during electrolysis that reacts on contact with the molten metal, the cell having a housing containing a plurality of electrode assemblies each including an anode, a cathode and at least one bipolar electrode disposed between said anode and said cathode so as to form interpolar spaces in which electrolysis occurs and the cathode forms an electrically and mechanically continuous surface surrounding the outermost at least one bipolar electrode, and connections for conveying electrical current to and from said electrode assemblies; wherein each electrode assembly is provided with a hood enclosing an upper portion of said assembly such that (a) the hood in operation provides a gas collection chamber such that said gas generated by the said electrode assembly is isolated from the remaining electrode assemblies, and (b) the hood and outer surface of the cathode are in a spaced relationship so that in operation, electrolyte flow containing the metal formed on the electrodes can flow over the top of the cathode and under the edge of the hood substantially adjacent the cathode over which it flowed.

19. An integral electrolysis unit comprising an electrode assembly having an anode, a cathode and at least one interpolar electrode, and a hood encircling an upper end of said electrode assembly, said hood including a lower end sealed in a gas-tight manner against a periphery of said cathode, except at at least one open aperture at a point on said periphery of said cathode.

20. A method of recovering a metal by electrolysis from a molten electrolyte containing a metal compound, the molten metal having a density lower than the molten electrolyte and the compound producing a gas during electrolysis that reacts on contact with the molten metal, in which electrolysis is conducted in a cell having a housing containing a plurality of electrode assemblies each including an anode, a cathode and at least one interpolar electrode disposed between said anode and said cathode so as to form interpolar spaces in which electrolysis occurs, and connections for conveying electrical current to and from said electrode assemblies; wherein said gas from each electrode assembly is collected in a hood enclosing an upper portion of the electrode assembly including the cathode of said assembly and providing a gas collection chamber, such that said gas generated by each said electrode assembly is isolated from other electrode assemblies and from metal collecting in said housing outside each said hood.

21. The method of claim 20, wherein metal-containing molten electrolyte from each electrode assembly is caused to flow under a lower end of said hood at substantially all points around a periphery of said lower end of the hood.

22. The method of claim 20 wherein the electrolyte flow through each electrode assembly is controlled by at least one control parameter selected from the group consisting of the depth of immersion of said hood in said electrolyte, and the vacuum applied to the said hood; said control parameter being used to equalize the performance of the said plurality of electrode assemblies in a cell.

* * * * *